US005456239A

United States Patent [19]

Henderson et al.

[11] Patent Number: 5,456,239

[45] Date of Patent: Oct. 10, 1995

[54] CRANKCASE VENTILATION SYSTEM

[75] Inventors: Gregory H. Henderson; David M. Ruch, both of Columbus, Ind.; Brian W. Zellmer, Medina, Ohio; Chad L. Kelly, Gahanna, Ohio; Philip C. Kreimer, Cincinnati, Ohio

[73] Assignee: Cummins Engine Company, Inc., Columbus, Ind.

[21] Appl. No.: 281,223

[22] Filed: Jul. 27, 1994

[51] Int. Cl.[6] ..... F16K 7/17; F01M 13/00

[52] U.S. Cl. ..... 123/563; 123/572

[58] Field of Search ..... 123/572, 573, 123/574, 41.86, 559.1, 559.2, 559.3, 563, 198 D

[56] References Cited

U.S. PATENT DOCUMENTS

| | | | |
|---|---|---|---|
| 3,754,538 | 8/1973 | Ephraim et al. | 123/198 D |
| 3,834,156 | 9/1974 | Cutler | 123/572 |
| 3,978,671 | 9/1976 | Gonzalez | 123/572 |
| 4,167,164 | 9/1979 | Bachmann | 123/574 |
| 4,557,226 | 12/1985 | Mayer et al. | 123/572 |
| 4,593,672 | 6/1986 | Barone | 123/573 |
| 4,901,703 | 2/1990 | Humphries | 123/572 |
| 4,962,745 | 10/1990 | Ohno et al. | 123/572 |
| 5,090,393 | 2/1992 | Holch | 123/574 |
| 5,205,265 | 4/1993 | Kashiyama et al. | 123/572 |

*Primary Examiner*—Marguerite Macy

*Attorney, Agent, or Firm*—Woodard, Emhardt, Naughton, Moriarty & McNett

[57] ABSTRACT

A crankcase ventilation system for a vehicle includes an arrangement of flow conduits and control valves which cooperate with a two-chamber accumulator and with various vehicle components to route crankcase gases to the intake manifold. The primary vehicle components include a compressor, an aftercooler positioned downstream from the compressor, and an engine having an intake manifold and a crankcase. One chamber of the accumulator is coupled by one conduit to the inlet side of the compressor and by a second conduit to the outlet side of the compressor. These two conduits are controlled by a dual valve arrangement. The other chamber of the accumulator is connected by one conduit to the crankcase and by a separate conduit to the intake manifold. Each conduit includes a control valve. The system operates on pressure differences existing between these various components. The cycle begins by opening the conduit which is connected to the inlet side of the compressor. This creates a low pressure on that side of the diaphragm. Due to their higher pressure, the crankcase gases empty into the accumulator and when a predetermined pressure is reached, the various valves change state, allowing the high pressure side of the compressor to empty into the accumulator. This pushes the lower pressure crankcase gases out of the accumulator through a different conduit to the intake manifold. These crankcase gases are then burned in the cylinders and the crankcase gases are not vented directly to the atmosphere.

18 Claims, 3 Drawing Sheets

CRANKCASE VENTILATION SYSTEM

BACKGROUND OF THE INVENTION

The present invention relates generally to the handling of crankcase gases (which are presently vented to the atmosphere) in a more environmentally friendly manner. More specifically, the present invention relates to the use of an accumulator for the temporary storage of crankcase gases and a pressure difference-based flow system which transfers such gases to the intake manifold to be burned as part of the normal engine combustion cycle within the cylinders.

At the present time, internal combustion engine emissions are subject to regulations promulgated or issued by the EPA and CARB. These emissions regulations are directed generally to tailpipe or stack exhaust. There is, however, another source of what could be termed harmful emissions, and this includes the gases in the crankcase which are currently vented directly to the atmosphere. Venting of such gases is important in order to prevent an unacceptable pressure buildup within the crankcase. These crankcase gases may be a mixture of "blowby" gases and vaporized oil and oil mist. Blowby gases are typically the result of combustion gases and air that get past the piston rings into the crankcase. These gases may pick up significant amounts of engine oil, which often drips on the ground, despite the use of gas/oil separators at the crankcase exit. The oil content of such gases is significant even without visible dripping. There are likely trace amounts of other gases, but regardless of the exact composition and proportions, these crankcase gases which enter the atmosphere are not what would be considered to be environmentally friendly. Consequently, it is anticipated that new federal and CARB emissions regulations will not allow the discharge of these gases to the atmosphere to continue. It is anticipated that new emissions regulations will require the inclusion of crankcase gases as part of regulated diesel engine emissions.

If, in fact, such regulations are promulgated, some system will be required in order to prevent the venting of crankcase gases directly to the atmosphere. Some type of treatment or filtering will be required, though no specific designs prior to the present invention are known to provide an adequate solution. Until such time as regulations are actually promulgated, there is only speculation as to what emissions levels may be specified for each type or category of pollutant. However, if the crankcase gases are burned by combustion within the engine cylinders, the resulting emissions should then be governed by the present EPA and CARB emissions regulations.

Therefore, the present invention is directed to a system, with various embodiments, which is capable of first capturing the crankcase gases rather than venting them directly to the atmosphere and then cycling those gases into the intake manifold where they are mixed with inlet air and burned in the cylinders. Effectively, this will result in substantially reducing, if not virtually eliminating, the unburned hydrocarbons from the crankcase gases. The present invention uses existing engine pressure differentials to transport the crankcase gases to anti from a two-chamber accumulator.

While earlier crankcase ventilation systems are known to exist, none are believed to be directed to the specific approach contemplated and provided by the present invention. The following patent references are believed to be a representative sampling of such earlier-crankcase ventilation systems:

| PATENT NO. | PATENTEE | ISSUE DATE |
|---|---|---|
| 4,167,164 | Bachmann | Sep. 11, 1979 |
| 4,557,226 | Mayer et al. | Dec. 10, 1985 |
| 4,901,703 | Humphries | Feb. 20, 1990 |
| 5,205,265 | Kashiyama et al. | Apr. 27, 1993 |

SUMMARY OF THE INVENTION

A crankcase ventilation system for a vehicle which captures vented crankcase gases and routes them to the intake manifold for combustion, according to one embodiment of the present invention, comprises an accumulator which is designed with two chambers which are in turn separated by a flexible diaphragm. The crankcase ventilation system of the present invention is integrated into a vehicle engine network which includes a turbocharger compressor, an aftercooler, an intake manifold, and a crankcase. One chamber of the accumulator is flow coupled through two separate conduits to the inlet and the outlet sides of the compressor, respectively. The outlet side of the compressor coincides with the inlet to the aftercooler and the outlet of the aftercooler in turn is connected to the intake manifold. The other chamber of the accumulator is connected through one flow conduit to the crankcase and by a separate conduit to the intake manifold. By means of valves disposed in each of the conduits and by a control mechanism for the timing and sequencing of the valves, the crankcase ventilation system of the present invention operates on a two-step cycle. The first step is to allow one chamber of the accumulator to fill with crankcase gases during which step the flexible diaphragm moves so as to provide the required volume for these gases to collect within the accumulator. The second step of the process is to introduce compressed air at a higher pressure into the accumulator so as to expel the accumulated crankcase gases and deliver these gases to the intake manifold.

One object of the present invention is to provide an improved crankcase ventilation system including an accumulator for receiving and transferring crankcase gases.

Related objects and advantages of the present invention will be apparent from the following description.

DESCRIPTION OF THE PREFERRED EMBODIMENT

Figure 1:
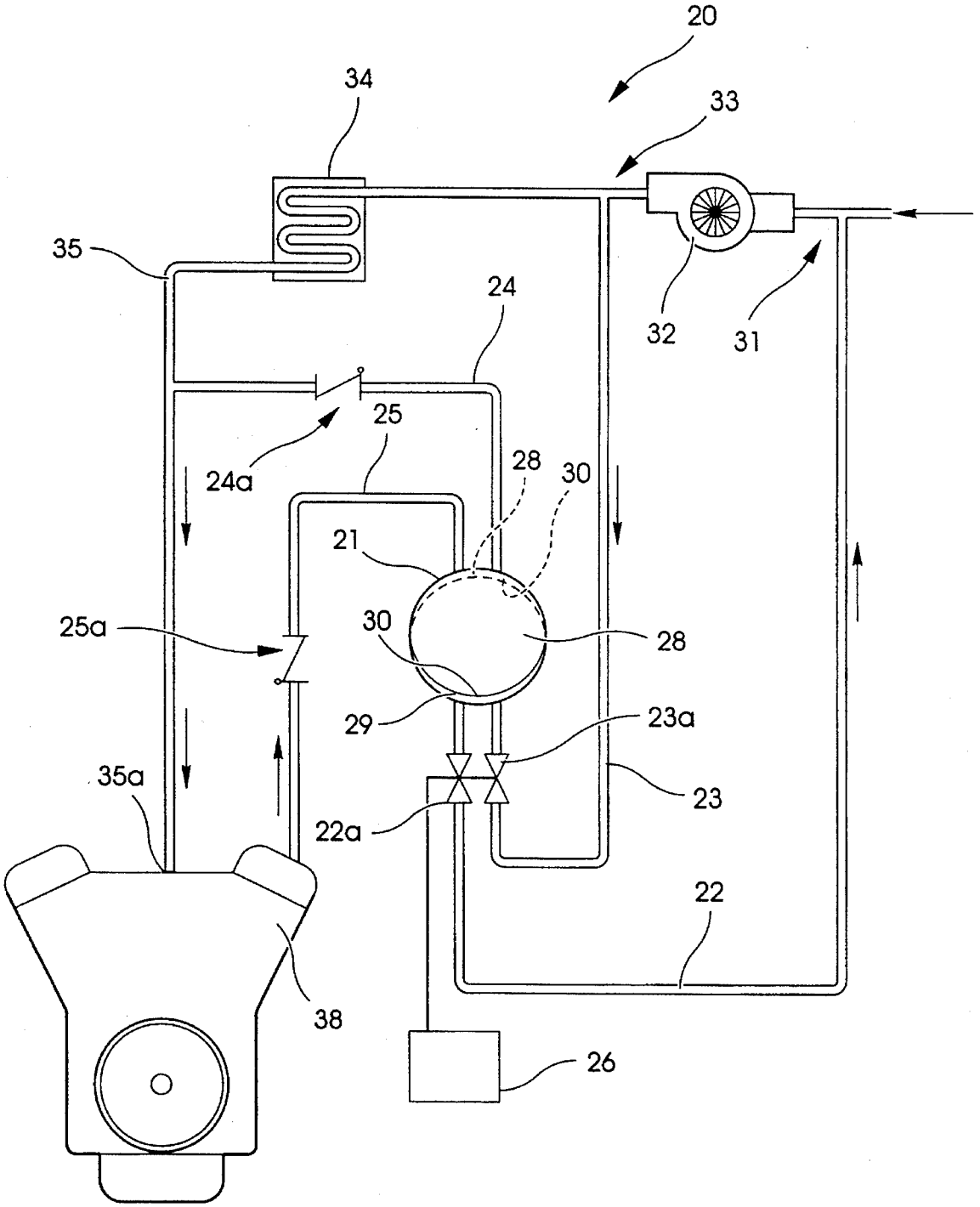
FIG. 1 is a diagrammatic representation of a crankcase ventilation system according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is illustrated, as a diagrammatic representation, a crankcase ventilation system 20. System 20 includes an accumulator 21 which is connected by four flow conduits 22, 23, 24, and 25 to existing portions and components of a typical or conventional diesel engine system. Positioned within each flow conduit is a control valve correspondingly identified as valves 22*a*, 23*a*, 24*a*, and 25*a*, respectively. Control unit 26 governs the operation and the opened or closed sequencing of valves 22*a* and 23*a*.

Accumulator 21 is arranged as a two-chamber receptacle including an engine-side chamber 28 which is separated from a compressor-side chamber 29 by a flexible membrane diaphragm 30. The broken line representation for diaphragm 30 illustrates its position when the size of chamber 28 is minimized and the size of chamber 29 is maximized. Chamber 29 is flow coupled to the inlet air side 31 of turbocharger compressor 32 via conduit 22 and valve 22*a*. Chamber 29 is additionally flow coupled via conduit 23 and valve 23*a* to the outlet side 33 of the compressor, which juncture also represents the inlet to the aftercooler 34.

The engine-side chamber 28 of accumulator 21 is flow coupled via conduit 24 and valve 24*a* to the outlet 35 of the aftercooler 34 which juncture also represents the intake manifold 35*a*. As described and used herein, the compressor outlet and aftercooler inlet 33 are effectively a common connection point in the sense of equivalent flows and pressure levels. The aftercooler outlet 35 and intake manifold 35*a* are also effectively a common connection point in the sense of equivalent flows and pressure levels. If there are any differences between the outlet point and inlet point of a common juncture, these are only seen as slight line losses as the fluids flow through the conduit.

Accumulator 21 is the primary component of system 20 and functions in a pulsating, two-stage manner, first accumulating crankcase gases via conduit 25 and then re-introducing those gases into the intake manifold 35*a*. The cycle begins with the compressor inlet valve 22*a* closed and the aftercooler inlet valve 23*a* open. Valves 22*a* and 23*a* can be cooperatively arranged as a dual acting valve such that they have different states and change states simultaneously. Valves 24*a* and 25*a* are configured as check valves so as to enable only one-way flow. In the case of valve 24*a* the flow direction is from the accumulator and in the case of valve 25*a* the flow is from the crankcase.

The first step in the cycle is to open valve 22*a* and close valve 23*a*. This then allows the compressor inlet vacuum in cooperation with a positive crankcase pressure to deliver crankcase gases to chamber 28. This expands the volume of chamber 28 by moving the flexible diaphragm 30 into or in the direction of chamber 29. When the accumulator has reached some predetermined level of crankcase gases within chamber 28, the compressor inlet valve 22*a* and aftercooler inlet valve 23*a* are returned to their original positions of closed and open, respectively, by the action of control unit 26. Throughout the cycle, any backflow from the accumulator 21 to the crankcase 38 is prevented by the design of check valve 25*a*. Similarly, any backflow from the intake manifold 35*a* to the accumulator 21 is prevented by the design of check valve 24*a*.

Now with the dual acting valves 22*a* and 23*a* in their original positions, compressed inlet air via conduit 23 begins to fill chamber 29, moving or expanding the diaphragm 30 into and in the direction of chamber 28. The movement of diaphragm 30 due to the higher pressure entering via conduit 23 drives the crankcase gases which were accumulated in chamber 28 out of accumulator 21, through flow conduit 24 and into the intake manifold 35*a*. When the crankcase gases are purged from chamber 28 of the accumulator, the system is ready to begin another cycle.

By arranging the accumulator as a closed system with both chambers being tied into closed flow loops, the operating cycle is effectively a two-step cycle and as such has a relatively short cycle time. Another feature of system 20 is that the compressor inlet and aftercooler inlet are completely isolated from any portion of the crankcase gases, whether blowby gases, oil, or otherwise. This means that there will not be any fouling of either the compressor or the aftercooler due to the introduction of crankcase gases into either component.

While accumulator 21 has been illustrated and described as a two-chamber receptacle wherein the two chambers are separated by a flexible membrane diaphragm, other designs are contemplated. For example, a suitable accumulator design would include a cylinder-like receptacle with a free floating piston/ring assembly.

Figure 2:
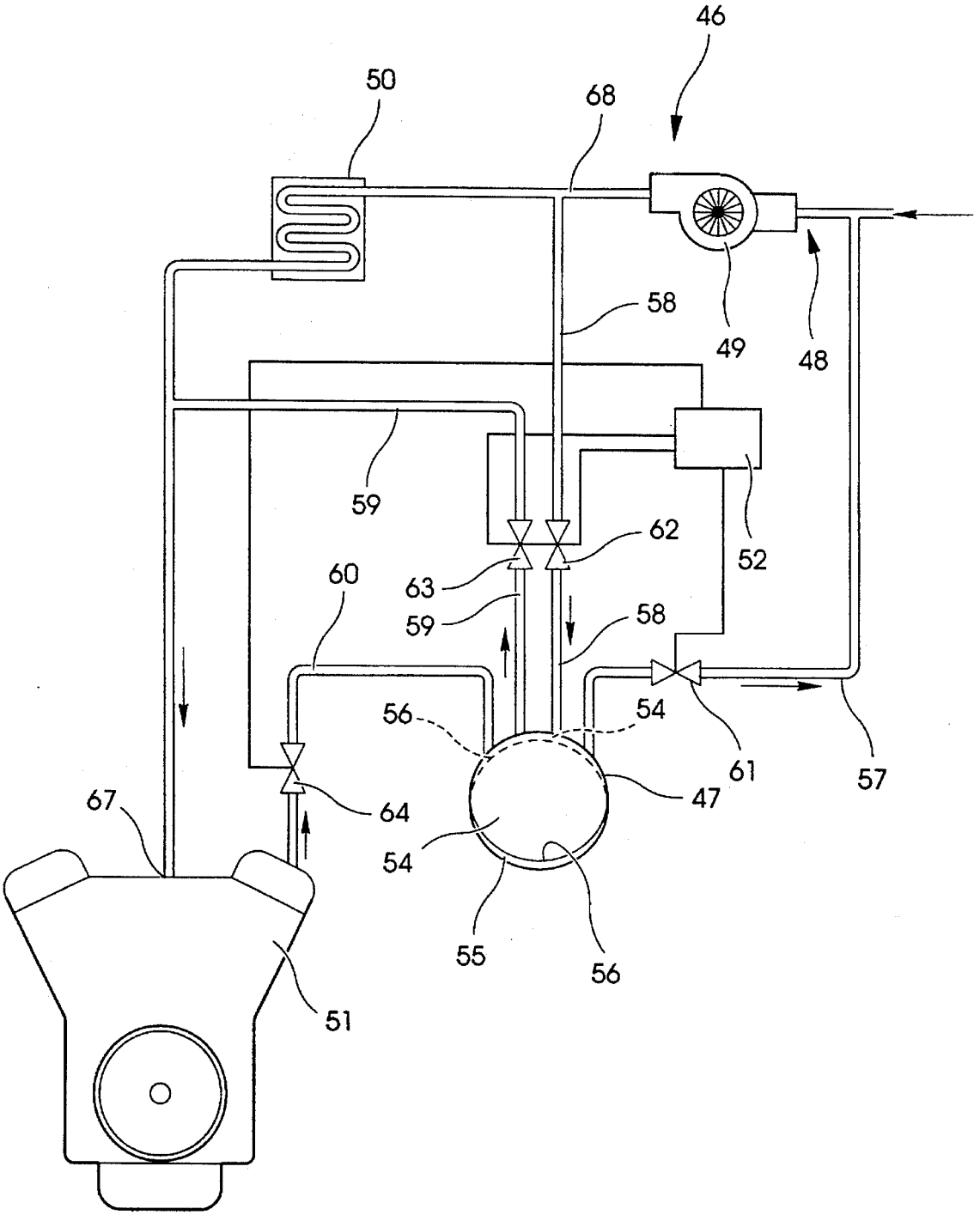
FIG. 2 is a diagrammatic representation of a crankcase ventilation system according to an alternative embodiment of the present invention.

Referring to FIG. 2, there is diagrammatically illustrated another embodiment of the present invention for a suitable crankcase ventilation system. System 46 includes accumulator 47 which is connected by flow conduits to the inlet air side 48 of compressor 49, to the upstream and downstream sides of aftercooler 50, and to crankcase 51. Each flow conduit is fitted with an opened/closed, two-position valve, and each of these various valves is controlled by control unit 52. The primary driving force behind the various flows are pressure differentials existing between various portions or components of system 46.

The accumulator 47 is designed as a two-chamber receptacle wherein the two chambers 54 and 55 are isolated from each other by a flexible membrane diaphragm 56. The broken line representation for diaphragm 56 illustrates its position when the size of chamber 54 is minimized and the size of chamber 55 is maximized. Chamber 54 is in open flow communication with flow conduits 57, 58, 59, and 60. Flow through these conduits is a result of pressure differences and the operation of control unit 52 which governs the opened or closed state of control valves 61, 62, 63, and 64. Chamber 55 is vented directly to the atmosphere. In effect, chamber 55 merely represents an atmospheric pressure side for diaphragm 56 and the flexing or expanding movement of the diaphragm controls the volume of chambers 54 and 55.

In accord with modern diesel engine designs, the inlet air is compressed by the compressor 49 and then cooled by aftercooler 50 before entering the engine as illustrated in FIG. 2. A below atmospheric, low pressure level exists at the inlet 48 of compressor 49 due to the inlet air restriction of the upstream air filter and associated ducting. Various high pressure levels, which are well above atmospheric pressure, and crankcase pressures exist downstream of the compressor. The inlet air flow experiences a significant frictional drop across the aftercooler which can then be used to purge the accumulator 47 as described herein. The crankcase 51 is maintained at a pressure level slightly above atmospheric pressure.

The operational cycle for system 46 begins with the compressor inlet valve 61 and the aftercooler valves 62 and 63 closed. The first step is to open the crankcase valve 64 and when this occurs, the existing crankcase pressure (which is above atmospheric pressure) drives the crankcase gases into chamber 54 of accumulator 47. To the extent necessary, based upon its starting position, diaphragm 56 is displaced by the entering crankcase gases. As expected, chamber 54 enlarges in volume as the crankcase gases fill the accumulator. The accumulator is sized so as to have the requisite volume capacity to handle the full volume of crankcase gases which may be generated during each cycle of system 46.

The second step in the operational cycle is to close the crankcase valve 64 and open both aftercooler valves 62 and 63. When valve 64 is closed, crankcase gases will begin to accumulate in the crankcase 51. However, these gases are not vented or otherwise allowed to escape immediately. Rather, they accumulate until the next cycle of system 46 at which time they are delivered to accumulator 47 through a differential pressure transfer and valve control, as described.

Due to the differential pressure across the aftercooler, clean compressed air flows around the aftercooler via conduit 58 from the compressor outlet 68 (aftercooler inlet) to the accumulator 47 and via conduit 59 from the accumulator to the intake manifold 67 (aftercooler outlet). This flow of clean compressed air through the accumulator purges the accumulator of the crankcase gases and transports them to the intake manifold 67. This step of purging the crankcase gases from the accumulator additionally increases the pressure in the accumulator to approximately the same high pressure level of the compressor outlet 68.

The third and final step in the operational cycle of system 46 is to close both aftercooler valves 62 and 63 and open the compressor inlet valve 61. The clean, high pressure air in the accumulator 47 then flows into the compressor inlet, again due to differential pressures. The below atmospheric pressure level at the compressor inlet creates a vacuum on the engine-side (chamber 54) of the diaphragm 56. This vacuum displaces the flexible diaphragm and reduces the volume of chamber 55. At this point, system 46 is ready to begin another cycle. The cycling time depends on a number of factors, including the speed of the flows, the responsiveness of the valves, and the size of the accumulator.

Figure 3:
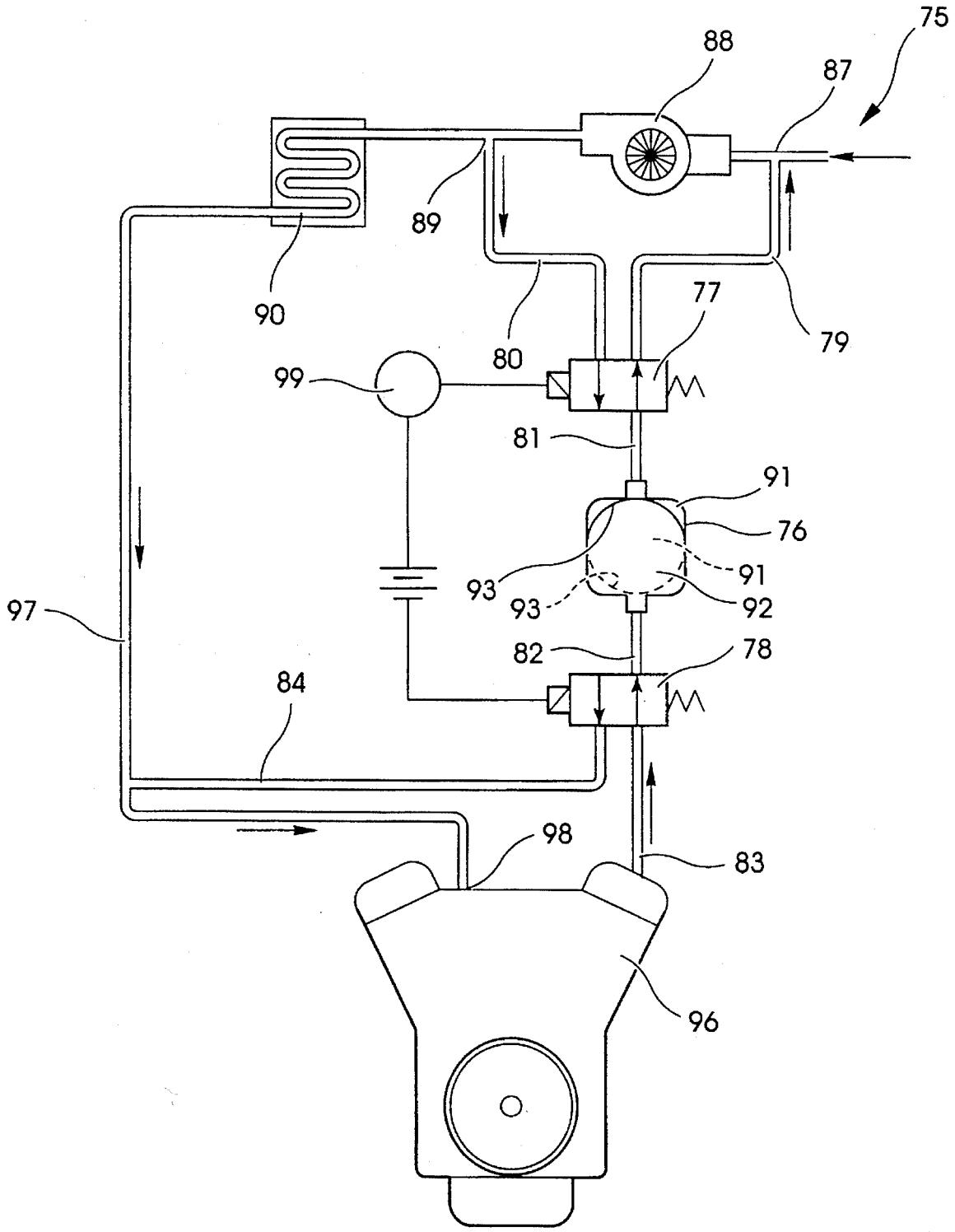
FIG. 3 is a diagrammatic representation of a crankcase ventilation system according to an alternative embodiment of the present invention.

A third embodiment of the present invention is illustrated in FIG. 3 whereat a diagrammatic representation of crankcase ventilation system 75 is provided. System 75 includes an accumulator 76, two, three-way solenoid valves 77 and 78, and flow conduits 79, 80, 81, 82, 83, and 84. As illustrated, conduit 79 flow couples one portion of solenoid valve 77 to the air inlet 87 of compressor 88. The common junction 89 of the compressor outlet and the aftercooler inlet is flow coupled to another portion of solenoid valve 77 by conduit 80. The outlet of aftercooler 90 is flow coupled directly to the intake manifold. The flow through conduits 79, 80, 83, and 84 is in only one direction while the flow through conduits 81 and 82 is in each or both directions.

Accumulator 76 is arranged into two chambers 91 and 92 which are separated by a flexible membrane diaphragm 93. Chamber 91 is flow coupled to solenoid valve 77 by conduit 81 and chamber 92 is flow coupled to solenoid valve 78 by conduit 82. One portion of solenoid valve 78 is flow coupled to crankcase 96 by conduit 83. Another portion of solenoid valve 78 is flow coupled by conduit 84 to the conduit 97 connecting the outlet of aftercooler 90 with the intake manifold 98. System 75 operates on a two-stage or two-step cycle wherein chamber 92 of the accumulator first fills with crankcase gases via conduits 83 and 82 and then empties that accumulation of crankcase gases to the intake manifold 98 via conduits 82 and 84. As with the accumulators of FIGS. 1 and 2, the broken line for diaphragm 93 represents the condition when the volume of chamber 92 is minimized and the volume of chamber 91 is maximized.

Solenoid valves 77 and 78 are each designed as a three-way, two-position valve. The use of solenoid valves in this type of system addresses any potential problems which check valves may pose in operating at low pressure differentials which could exist in such a crankcase ventilation system as described herein. A twelve-volt pressure switch/control unit 99 is used to control the switching of both solenoid valves as would be well known to one of ordinary skill in the art of designing and controlling such solenoid valves.

The operating cycle for system 75 begins with solenoid valve 78 open to the aftercooler outlet via conduit 84 and solenoid valve 77 open to the aftercooler inlet via conduit 80. The first step in the cycle is to switch solenoid valve 78 so that it is open to the crankcase 96 via conduit 83. Concurrently, solenoid valve 77 is switched so that it is open to the compressor inlet 87 via conduit 79. The compressor inlet vacuum and the positive crankcase pressure create a pressure differential which delivers crankcase gases to the accumulator. These gases expand the volume of chamber 92 by deflecting flexible diaphragm 93 into the solid line position which is illustrated. Chamber 92 of the accumulator 76 continues to fill with crankcase gases until the pressure within chamber 92 has reached a predetermined level. This level is preferably a pressure level, but it could also be arranged as a predetermined volume level.

Once this predetermined pressure is reached, the second step in the cycle begins by switching solenoid valves 77 and 78 back to their original positions. When this occurs, the compressed air at junction 89 pushes against the diaphragm 93 such that the crankcase gases are vented to the intake manifold 98. The pressure differential fills chamber 91 with compressed air which moves diaphragm 93 so as to collapse chamber 92. As the volume of chamber 92 is effectively eliminated, the crankcase gases accumulated therein must escape and the only available escape path delivers these gases to the intake manifold via conduit 82, solenoid 78 anti conduit 84.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A crankcase ventilation system for a vehicle which captures vented crankcase gases and routes them to an intake manifold for combustion, said vehicle including a compressor having an air inlet, an aftercooler located downstream from said compressor and having an inlet to receive compressed air from said compressor, and an engine located downstream from said aftercooler, said engine having an intake manifold and crankcase, said crankcase ventilation system comprising:

an accumulator designed with two chambers which are separated by a flexible diaphragm;

first flow coupling means for selectively placing a first chamber of said accumulator in flow communication with said compressor air inlet;

second flow coupling means for selectively placing said first chamber in flow communication with said aftercooler inlet;

third flow coupling means for selectively placing a second chamber of said accumulator in flow communication with said intake manifold;

fourth flow coupling means for selectively placing said second chamber in flow communication with said crankcase; and flow control means for determining the sequence and cycling of flow communication with the chambers of said accumulator wherein the second chamber, expanded by the movement of said diaphragm, fills with crankcase gases and then empties those gases to the intake manifold in response to the introduction of compressed air into the first chamber of said accumulator.

2. The crankcase ventilation system of claim 1 wherein said first flow coupling means includes a first flow conduit in combination with a first one-way flow valve.

3. The crankcase ventilation system of claim 2 wherein said second flow coupling means includes a second flow conduit in combination with a second one-way flow valve.

4. The crankcase ventilation system of claim 3 wherein said third flow coupling means includes a third flow conduit in combination with a third one-way flow valve.

5. The crankcase ventilation system of claim 4 wherein said fourth flow coupling means includes a fourth flow conduit in combination with a fourth one-way flow valve.

6. The crankcase ventilation system of claim 5 wherein the direction of flow through said first one-way flow valve relative to said accumulator is opposite to the direction of flow through said second one-way flow valve relative to said accumulator.

7. The crankcase ventilation system of claim 6 wherein the direction of flow through said third one-way flow valve relative to said accumulator is opposite to the direction of flow through said fourth one-way flow valve relative to said accumulator.

8. A crankcase ventilation system for a vehicle which captures vented crankcase gases and routes them to an intake manifold for combustion, said vehicle including a compressor having an air inlet, an aftercooler located downstream from said compressor and having an inlet to receive compressed air from said compressor, and an engine located downstream from said aftercooler, said engine having an intake manifold and crankcase, said crankcase ventilation system comprising:

an accumulator designed with a first chamber, a second chamber, and a flexible diaphragm separating said first and second chambers, said second chamber being vented to the atmosphere;

first flow coupling means for selectively placing said first chamber in flow communication with said compressor air inlet;

second flow coupling means for selectively placing said first chamber in flow communication with said aftercooler inlet;

third flow coupling means for selectively placing said first chamber in flow communication with said intake manifold;

fourth flow coupling means for selectively placing said first chamber in flow communication with said crankcase; and flow control means for determining the sequence and cycling of flow communication with the first chamber of said accumulator wherein the first chamber is allowed to fill with crankcase gases when the pressure in said first chamber is below the pressure of said crankcase gases and wherein said crankcases gases are purged from said first chamber and routed to the intake manifold when compressed air at a pressure which is higher than the pressure of the crankcase gases is introduced into said first chamber.

9. The crankcase ventilation system of claim 8 wherein said first flow coupling means includes a first flow conduit in combination with a first one-way flow valve.

10. The crankcase ventilation system of claim 9 wherein said second flow coupling means includes a second flow conduit in combination with a second one-way flow valve.

11. The crankcase ventilation system of claim 10 wherein said third flow coupling means includes a third flow conduit in combination with a third one-way flow valve.

12. The crankcase ventilation system of claim 11 wherein said fourth flow coupling means includes a fourth flow conduit in combination with a fourth one-way flow valve.

13. The crankcase ventilation system of claim 12 wherein the direction of flow through said first one-way flow valve relative to said accumulator is opposite to the direction of flow through said second one-way flow valve relative to said accumulator.

14. The crankcase ventilation system of claim 13 wherein the direction of flow through said third one-way flow valve relative to said accumulator is opposite to the direction of flow through said fourth one-way flow valve relative to said accumulator.

15. A crankcase ventilation system for a vehicle which captures vented crankcase gases and routes them to an intake manifold for combustion, said vehicle including a compressor having an air inlet, an aftercooler located downstream from said compressor and having an inlet to receive compressed air from said compressor, and an engine located downstream from said aftercooler, said engine having an intake manifold and crankcase, said crankcase ventilation system comprising:

an accumulator designed with two chambers which are separated by a flexible diaphragm;

a first flow circuit including a first solenoid valve and three flow conduits, a first flow conduit connecting said solenoid valve to the compressor air inlet, a second flow conduit connecting said solenoid valve to the aftercooler inlet, and a third flow conduit connecting said solenoid valve to a first chamber of said accumulator;

a second flow circuit including a second solenoid valve and three flow conduits, a first flow conduit connecting said solenoid valve to a second chamber of said accumulator, a second flow conduit connecting said, solenoid valve to the crankcase, and a third flow conduit connecting said solenoid valve to the intake manifold; and flow control means for determining the sequence and cycling of flow communication with the chambers of said accumulator wherein the second chamber, expanded by the movement of said diaphragm, fills with crankcase gases and then empties those gases to the intake manifold in response to the introduction of compressed air into the first chamber of said accumulator.

16. The crankcase ventilation system of claim 15 wherein the flow through the first flow conduit of said first flow circuit is one-directional, the flow through the second flow conduit of said first flow circuit is one-directional, and the flow through the third flow conduit of said first flow circuit is two-directional.

17. The crankcase ventilation system of claim 16 wherein the flow through the second flow conduit of said second flow circuit is one-directional, the flow through the third flow conduit of said second flow circuit is one-directional, and the flow through the first flow conduit of said second flow circuit is two-directional.

18. The crankcase ventilation system of claim 17 wherein said flow control means includes a pressure switch.

* * * * *